US005382836A

United States Patent [19]

Umemura

[11] Patent Number: 5,382,836

[45] Date of Patent: Jan. 17, 1995

[54] PUSH-BUTTON SWITCH DEVICE

[75] Inventor: Heihachiro Umemura, Sakai, Japan

[73] Assignee: Shinkoh Electric Co., Ltd., Osaka, Japan

[21] Appl. No.: 994,339

[22] Filed: Dec. 21, 1992

[30] Foreign Application Priority Data

Sep. 28, 1992 [JP] Japan ..... 4-283677

[51] Int. Cl.[6] ..... H01H 13/64

[52] U.S. Cl. ..... 307/127; 307/115

[58] Field of Search ..... 307/113, 115, 125, 127, 307/130, 131, 559

[56] References Cited

U.S. PATENT DOCUMENTS

| | | | |
|---|---|---|---|
| 2,892,132 | 6/1959 | Mallory | 361/191 |
| 3,794,888 | 2/1974 | Hisano | 307/114 X |
| 4,004,156 | 1/1977 | Schuller | 307/113 |
| 4,213,059 | 7/1980 | Deacey | 307/41 |
| 4,367,510 | 1/1983 | Watanabe | 307/114 X |

*Primary Examiner*—A. D. Pellinen
*Assistant Examiner*—F. M. Fleming
*Attorney, Agent, or Firm*—Wenderoth, Lind & Ponack

[57] ABSTRACT

A switch unit receive an AC signal and includes first and second push-button switches and at least one rectifying diode. Each of the first and second push-button switches is a 2-stage switch or a 3-stage switch. The first and second push-button switches and the at least one rectifying diode are configured such that the switch unit selectively generates any one of a non-signal, a positive half-wave rectified signal, a negative half-wave rectified signal and a full wave alternating signal to each of first and second outputs. The first and second outputs of the switch units are transmitted to an output unit by way of two transmission wires, respectively. The output unit discriminates the switching state of the first and second push-button switches based on the signal received from the switch unit via the two transmission wires.

1 Claim, 10 Drawing Sheets

| PB1 | PB2 | S1 | PC1 | PC2 |
|---|---|---|---|---|
| OFF | OFF | | | |
| ON | OFF | | | |
| OFF | ON | | | |
| ON | ON | | | |

FIG. 3
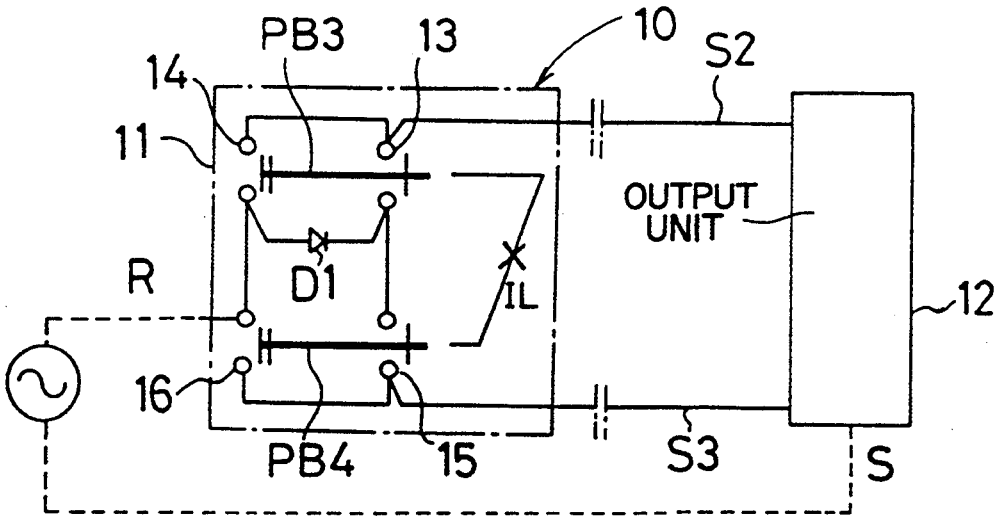
FIG. 4
| PUSH-BUTTON | | OUTPUT | |
|---|---|---|---|
| PB 3 | PB 4 | S2 | S3 |
| 0 | 0 | W0 | W0 |
| 1 | 0 | W1 | W0 |
| 2 | 0 | W2 | W0 |
| 0 | 1 | W0 | W1 |
| 0 | 2 | W0 | W2 |
FIG. 5
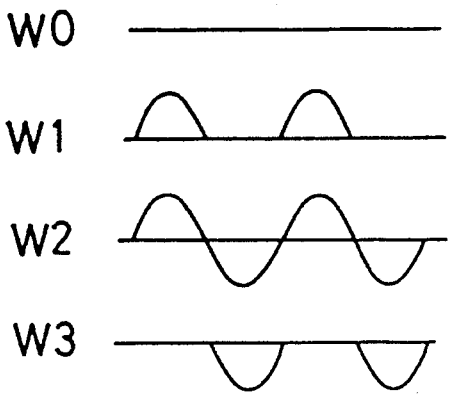

FIG. 6
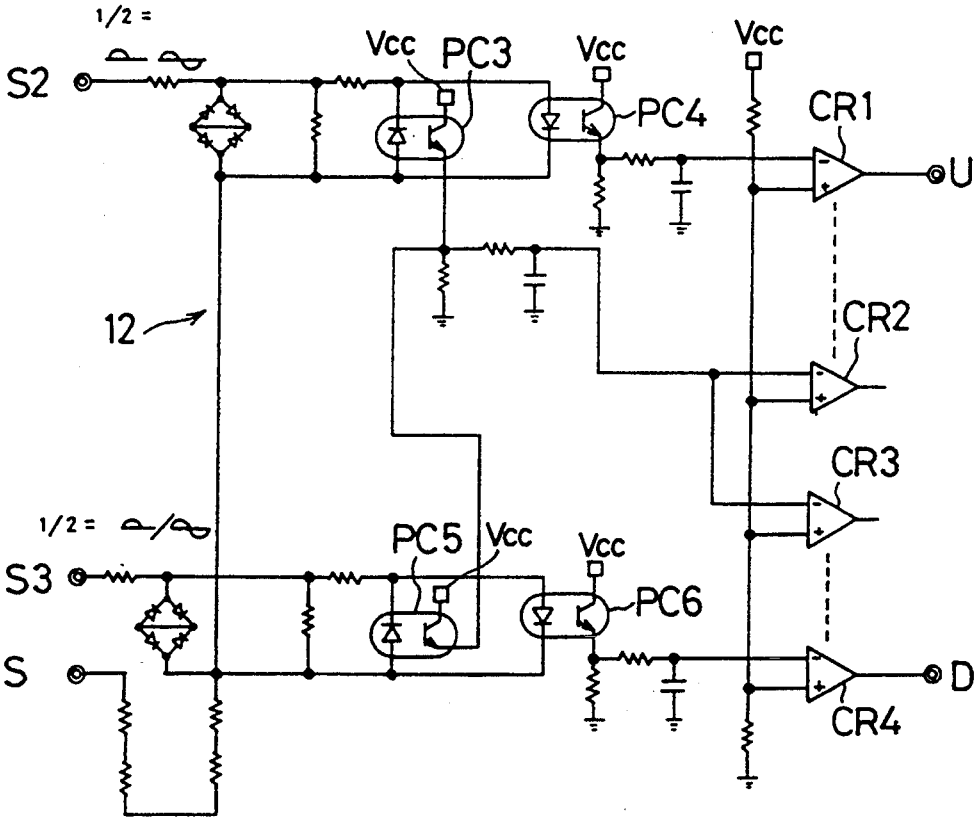
FIG. 7
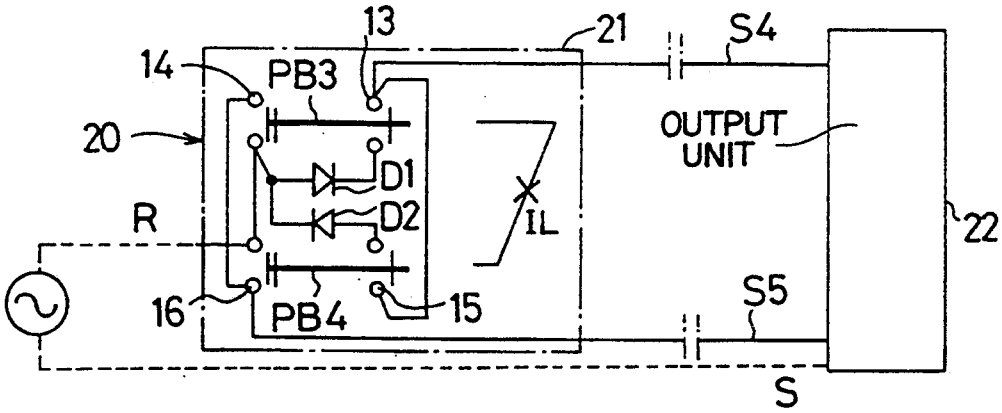
FIG. 8
| PUSH-BUTTON | | OUTPUT | |
|---|---|---|---|
| PB3 | PB4 | S4 | S5 |
| 0 | 0 | W0 | W0 |
| 1 | 0 | W1 | W0 |
| 2 | 0 | W1 | W2 |
| 0 | 1 | W3 | W0 |
| 0 | 2 | W3 | W2 |

FIG. 9
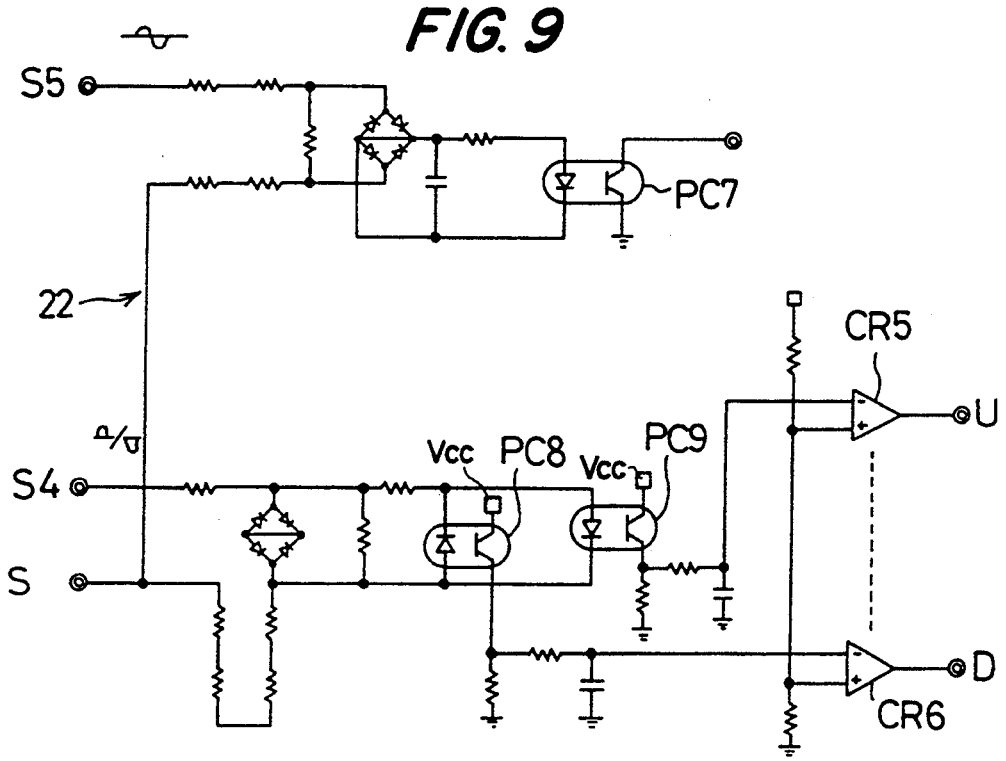
FIG. 10
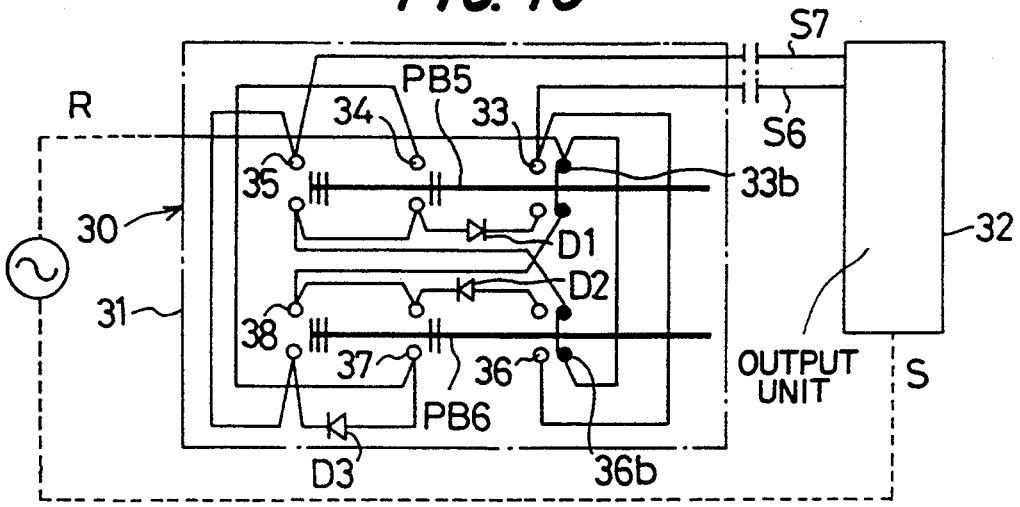
FIG. 11
| PUSH-BUTTON | | OUTPUT | |
|---|---|---|---|
| PB5 | PB6 | S6 | S7 |
| 0 | 0 | W0 | W0 |
| 1 | 0 | W1 | W0 |
| 2 | 0 | W1 | W1 |
| 3 | 0 | W1 | W2 |
| 0 | 1 | W3 | W0 |
| 0 | 2 | W3 | W1 |
| 0 | 3 | W3 | W2 |

| PUSH-BUTTON | | OUTPUT | |
|---|---|---|---|
| PB7 | PB8 | S8 | S9 |
| 0 | 0 | W0 | W0 |
| 1 | 0 | W1 | W0 |
| 2 | 0 | W1 | W1 |
| 3 | 0 | W1 | W2 |
| 0 | 1 | W3 | W0 |
| 0 | 2 | W3 | W1 |
| 0 | 3 | W3 | W2 |

| PUSH-BUTTON | | OUTPUT | |
|---|---|---|---|
| PB9 | PB10 | S10 | S11 |
| 0 | 0 | W0 | W0 |
| 1 | 0 | W1 | W0 |
| 2 | 0 | W2 | W0 |
| 3 | 0 | W3 | W0 |
| 0 | 1 | W0 | W1 |
| 0 | 2 | W0 | W2 |
| 0 | 3 | W0 | W3 |

PUSH-BUTTON SWITCH DEVICE

BACKGROUND OF THE INVENTION

The present invention relates to a push-button switch device, and in particular a push-button switch device suitable for equipment incorporating a large number of push-button switches such as pendant switches.

FIG. 19 depicts the electric circuit of a 2-step type push-button switch for controlling an inverter used generally for a pendant switch. The push-button switch device 100 consists of a switch unit 101 and an output unit connected to an AC source at respective R and S terminals. The switch unit 101 is provided with two push-button switches PBa, PBb. The push-button switch PBa is provided with a 1st-stage switch 103 and a 2nd-stage switch 104 while the push-button switch PBb has a 1st-stage switch 105 and a 2nd-stage switch 106. FIG. 19 shows an example in which the 2nd-stage switches of the both push-button switches transmit a one same signal and are connected to one same transmitting line al.

With this arrangement, the 3 kinds of signals transmitted by the switch unit 101 are connected with the output unit 102 by transmitting lines a1, a2, a3 respectively, and the output unit 102 works with the signals from the switch unit 107 through detecting members 107, 108, 109 each formed by a photocoupler, for example, provided for the respective transmitting lines, so as to transmit operating signals. Namely, the 3 transmitting lines a1, a2, a3 are required to transmit 3 different kinds of signals. For that reason, equipment incorporating a large number of push-button devices in one operating unit such as a pendant switch for operating a crane, hoist, etc., for example, requires wires of a number at least 3 times larger than the number of push-button switch devices plus one common line.

In that case, there is no problem if the number of push-button switch devices incorporated in the pendant switch, etc. is small. In recent times, however, inverter control is being increasingly used in place of the electromagnetic contactor and the specifications of pendant switch are becoming more an more complicated with incorporation of a buzzer switch or switching between linked operation and single operation, etc. Therefore, there is a general tendency for multi-point construction of the pendant switch and multi-stage construction of individual switches. This leads to an increase in the number of cable wires, an increase in the outer dimensions of the pendant switch and an increase in the weight of the cable itself. As a result, the wire bundle becomes rigid and makes the operation of pendant switch difficult in some cases.

SUMMARY OF THE INVENTION

The object of the present invention is to reduce the size of the switch unit and the reduce the number of wires by adopting a double transmission system in which a plural number of signals are transmitted through one cable to simplify the circuit.

To achieve the above object, the present invention is composed of a switch unit having a pair of push-button switches and diodes and an output circuit for detecting an electric current sent from the switch unit, in which selective closing of the push-button switches in the switch unit results in transmitting a plural number of signals, those plural number of signals being transmitted to the output unit through a common transmitting line, and in which the output unit is provided with discriminating means for discriminating such signals and transmitting prescribed operating signals according to the signal current.

With such arrangement, the push-button switch device of the present invention can reduce the number of the signal lines conducted between the switch unit and the output unit. Therefore, if the switch unit is incorporated in a pendant switch, for example, it is possible to reduce the weight of the conductors themselves and increase the operability and the reliability of the pendant switch at the same time. Moreover, it becomes possible to use the same cable as the signal line of an AC commercial voltage circuit without using any special shielded wire, etc. as the signal line.

BRIEF DESCRIPTION OF THE DRAWINGS

FIG. 3 is a general circuit diagram of the second example of the push-button switch device of the present invention.

FIG. 4 is an explanatory chart of a signal current of the second example.

FIG. 5 is an explanatory chart of a signal current waveform.

FIG. 6 is a circuit diagram of the output unit of the second example.

FIG. 7 is a general circuit diagram of the third example of the push-button switch device of the present invention.

FIG. 8 is an explanatory chart of a signal current of the third example.

FIG. 9 is a circuit diagram of the output unit of the third example.

FIG. 10 is a general circuit diagram of the fourth example of the push-button switch device of the present invention.

FIG. 11 is an explanatory chart of a signal current of the fourth example.

DETAILED DESCRIPTION OF THE INVENTION

Figures 1, 2:
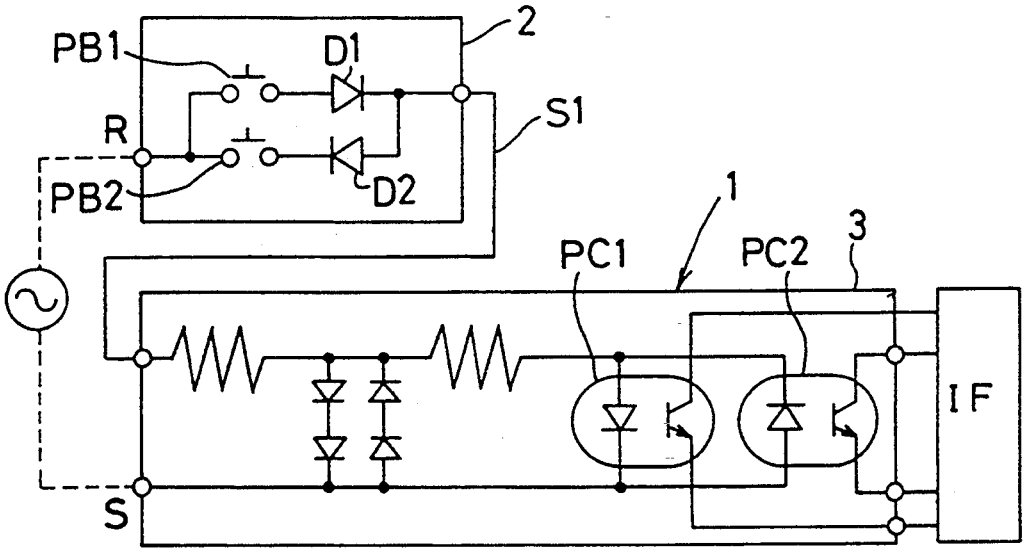
FIG. 1 is a general circuit diagram of the first example of the push-button switch device of the present invention.
FIG. 2 is an explanatory chart of a signal current of the first example.

The present invention will be explained hereafter based on an illustrated examples. It is noted that like parts are designated by like reference numeral and letters throughout the accompanying drawings.

FIG. 1 and FIG. 2 indicate the first example. This push-button switch device 1 consists of a switch unit 2 and an output unit 3. The switch unit 2 is composed of a pair of push-button switches PB1, PB2 and diodes D1, D2 (hereinafter simply referred to as PB for push-button switches and D for diodes when they are called by a general name in the respective examples). The push-button switch PB1 and the diode D1 are connected in series, with the diode D1 in a forward direction, while the push-button switch PB2 and the diode D2 are connected in series, with the diode D2 in a reverse direction, and these two circuits are connected in parallel. The two circuits are connected to the output unit 3 through a common transmitting line S1.

The output unit 3 is provided with discriminating means PC1, PC2 (hereinafter simply referred to as PC when they are called by a general name). FIG. 1 shows an example of using photocouplers as such discriminating means and a phototransistor for output, but it is also possible to use a cds cell, MOS relay, etc. instead. One discriminating means PC1 works with a normal half-wave rectification signal i.e. closing of push-button switch PB1 and the other discriminating means PC2 works with a half-wave rectification signal in a reverse direction i.e. closing of push-button switch PB2, to apply operating signals to an interface IF, for example, of the next process.

FIG. 2 indicates the current flowing through the transmitting line S1 with the closing of the respective push-button switches and the output of the discriminating means in the output unit. Namely, upon closing of the push-button switch PB1, only a pulsating current of positive half-wave rectification is output and upon, closing of the other push-button switch PB2, only a pulsating current of negative half-wave rectification is output, and upon simultaneous closing of both push-button switches, full-wave alternating current is output. The respective discriminating means PC1, PC2 of the output unit 3 transmit output signals in response to such outputs as mentioned earlier. However, both discriminating means PC1, PC2 transmit output signals simultaneously in response to an alternating current. Namely, the switch circuit is arranged in such a way that the 4 signals produced with the closing of the respective push-button switches PB1, PB2 are transmitted to the output line 3 through one transmitting line S1.

Next, FIG. 3 to FIG. 6 indicate the second example. The push-button switch device of this example shows an a switch unit using a 2-stage type push-button switch in which the switch unit 11 of the push-button switch device 10 consists of a first push-button switch PB3, a second push-button switch PB4 and a diode D1. The first-stage switch 13 of the first push-button switch PB3 and the first-stage switch 15 of the second push-button switch PB4 are provided in series to the common diode D1 and closing of the other second-stage switches 14, 16 outputs an alternating signal respectively.

The first-stage switch 13 and the second-stage switch 14 of said first push-button switch PB3 and the first-stage switch 15 and the second-stage switch 15 of the second push-button switch PB4 are connected respectively to a common transmitting line S3.

Reference in the IL drawings, indicates an interlock provided to prevent simultaneous closing of the two push-button switches.

FIG. 4 shows outputs produced upon closing of the push-button switches. In the drawing, the columns 1, 2 of the push-button switches PB3, PB4 indicate the ON state of the first-stage switch and the second-stage switch respectively. The output waveform of those switches appears as shown in FIG. 5, W0 indicating 0 output, W1 the pulsation of positive half-wave rectification and W2 the alternating current of full wave, while W3 indicates the pulsation of negative half-wave rectification.

FIG. 6 indicates the output unit 12. This output unit 12 is constituted as an interface circuit and is provided with detectors PC3, PC4 forming a pair with the output line S2 and being in opposite phase, and discriminating means PC5, PC6 forming a pair with the output line S3 and being in opposite phase. With such an arrangement, the output unit 12 discriminates positive or negative of the signal current sent through the respective transmitting lines S2, S3 and selects those signals to apply a signal current to comparators CR1, CR2, CR3, CR4 through an integrating circuit of a resistor and capacitor to a control inverter as operating current signals U, D; etc. (illustration omitted).

Namely, in this example, the two signals or the positive half-wave rectification signal and the alternating signal sent from the push-button switch PBR of the switch unit are transmitted to the output line 12 through one transmitting line S2 and the positive half-wave rectification signal and the alternating signal sent from the push-button switch PB4 are transmitted to the output line 12 through one transmitting line S3.

Next, FIG. 7 to FIG. 9 indicate the third example. The switch unit 21 of the push-button switch device 20 of this example is also provided with diodes D1, D2 forming pairs with 2-stage push-button switches PB3, PB4 in the same way as the preceding example. The diode D1 is provided in a forward direction in the first-stage switch 13 of the push-button switch and the diode D2 is provided in a reverse direction in the first-stage switch 15 of the push-button switch PB4 in series respectively. The two switches PB3, PB4 are connected to the first transmitting line S4. The second-stage switches 14, 16 are connected to the second transmitting line S5.

FIG. 8 indicates outputs produced upon closing of push-button switches of this example. The output waveform of those switches appears as shown in FIG. 5, W0 indicating 0 output, W1 the output current of the pulsation of positive half-wave rectification and W2 that of the alternating current of full wave, while W3 indicates the output current of the pulsation of negative half-wave rectification.

FIG. 9 indicates the output unit 22 of this example. This output unit 22 is also constituted as an interface circuit as in the previous example. Only an alternating current signal is applied to the transmitting line S5 and it is discriminated by the discriminating means PC7. To the other transmitting line S4, signal currents of positive and negative half-wave rectifications are applied and discriminated by 2 discriminating means PCS, PC9. Those signals are selected and applied to the comparators CR5, CR6 through an integrating circuit of resistors and capacitors to generate operating current signals U, D. Namely, the two signals are transmitted to the transmitting line S4 and are discriminated by the output unit.

Figure 12:
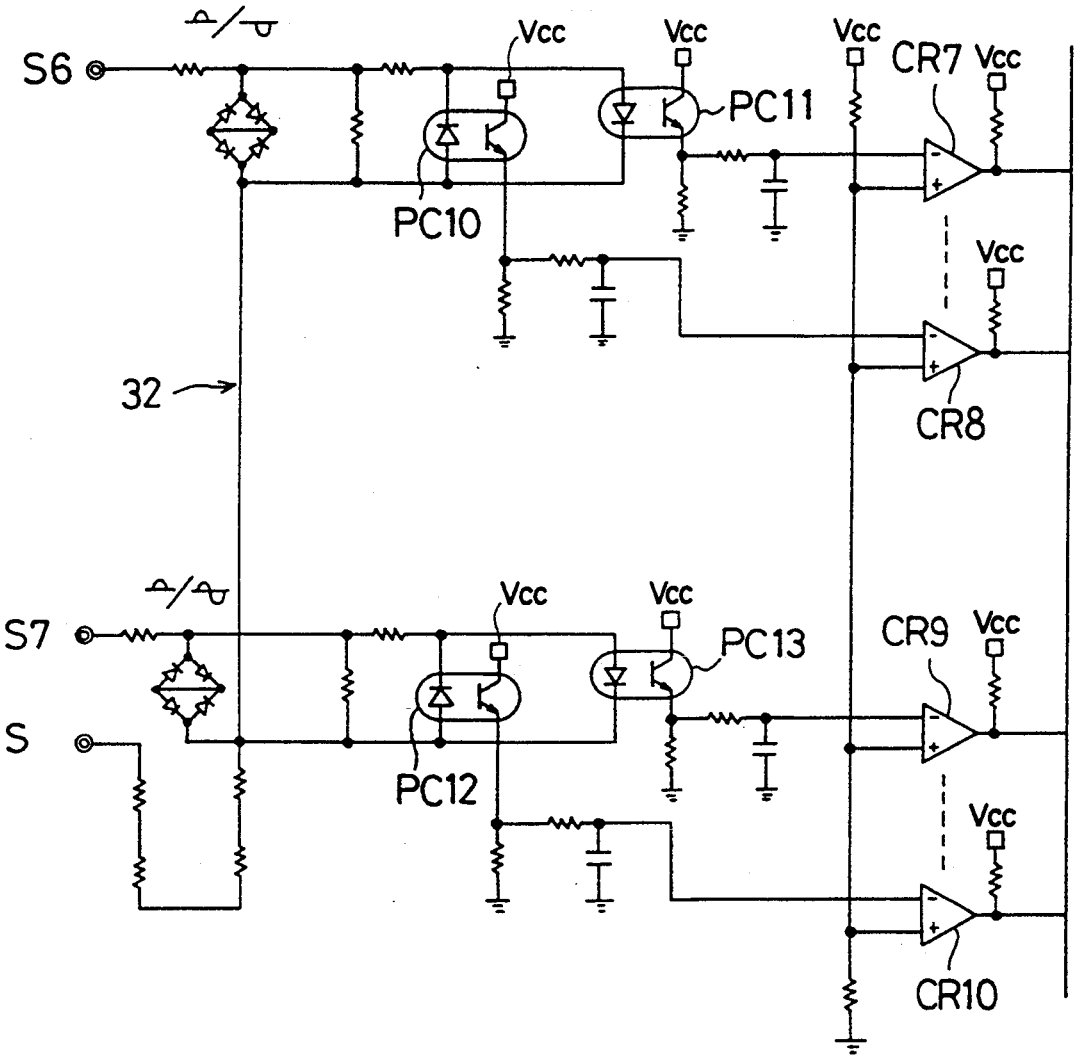
FIG. 12 is a circuit diagram of the output unit of the fourth example.

Next, FIG. 10 and FIG. 12 indicate the fourth example of the push-button device. The switch unit 31 of the push-button switch device 30 of this example is provided with pair of 3-stage push-button switches PBS, PB6 and 3 diodes D1, D2, D3. The respective first contacts 33, 36 of the push-button switches PB5, PB6 are accompanied by normally closed contacts 33*b*, 36*b*. The said diode D1 is connected to the first contact 33 of the first push-button switch PB5 in series in a forward direction and the diode D2 is connected to the first contact 36 of the first push-button switch PB6 in a series in reverse direction, and both first contacts 33, 36 are connected to the output unit 32 through a common first transmitting line S6. Moreover, the diode D3 is connected to the second contact 37 of the second push-button switch PB6 in series in a forward direction, and the second contacts 34, 37 and third contacts 35, 38 of the respective push-button switches are connected to the output unit 32 through a common second transmitting line S7.

FIG. 11 indicates the outputs produced upon closing of the push-button switches of this example. According to this example, 2 different kinds of signals can be transmitted to each of the two transmitting lines S6, S7 or 4 different kinds of signals in total can be transmitted. FIG. 12 indicates an example of output unit according to this example. This output unit 32 is also realized as an interface circuit as in the previous example. Pulsating signal currents of positive and negative half-wave rectification are applied to the transmitting line S6 and discriminated by a pair of discriminating means PC10, PC11. To the other transmitting line S7, a pulsating signal current of positive half-wave rectification and an alternating signal current are applied and discriminated by 2 discriminating means PC12, PC13. These signals are selected and applied to the comparators CR7, CR8, CR9 and CR10 through an integrating circuit of resistors and capacitors. Namely, each of the two transmitting lines S6, S7 transmits 2 different kinds or signals, or 4 kinds of signals in total, and the output unit discriminates them with discriminating means and produces outputs corresponding to the signals.

Figures 13, 14:
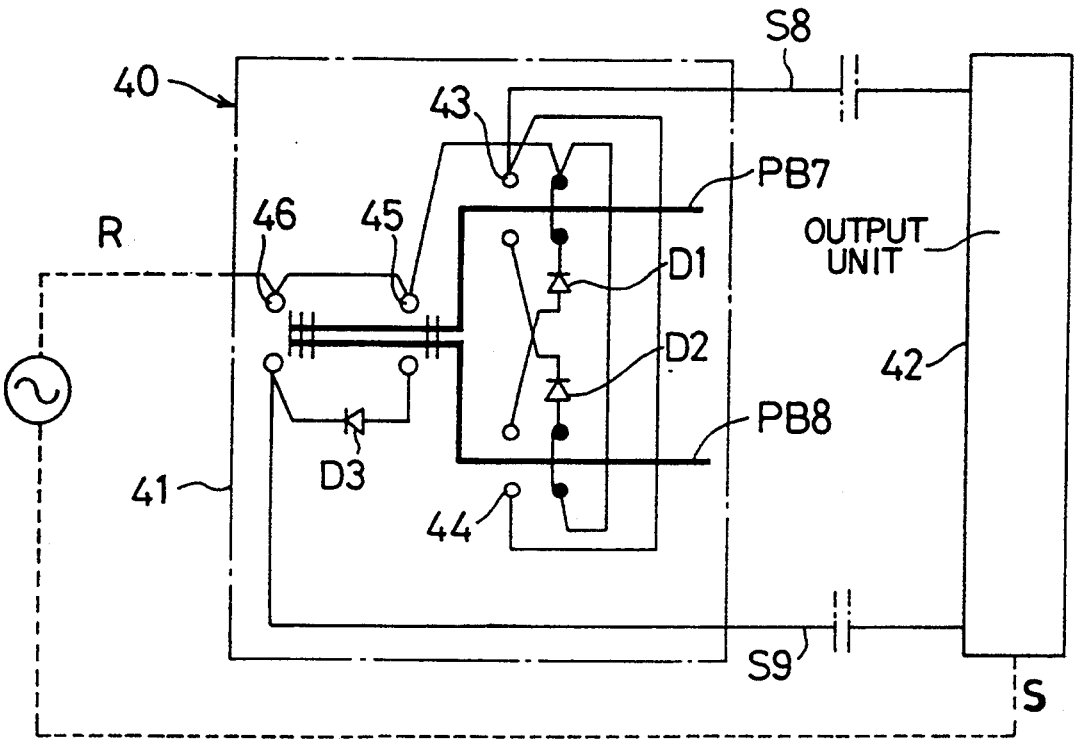
FIG. 13 is a general circuit diagram of the fifth example of the push-button switch device of the present invent ion.
FIG. 14 is an explanatory chart of a signal current of the fifth example.
Figure 15:
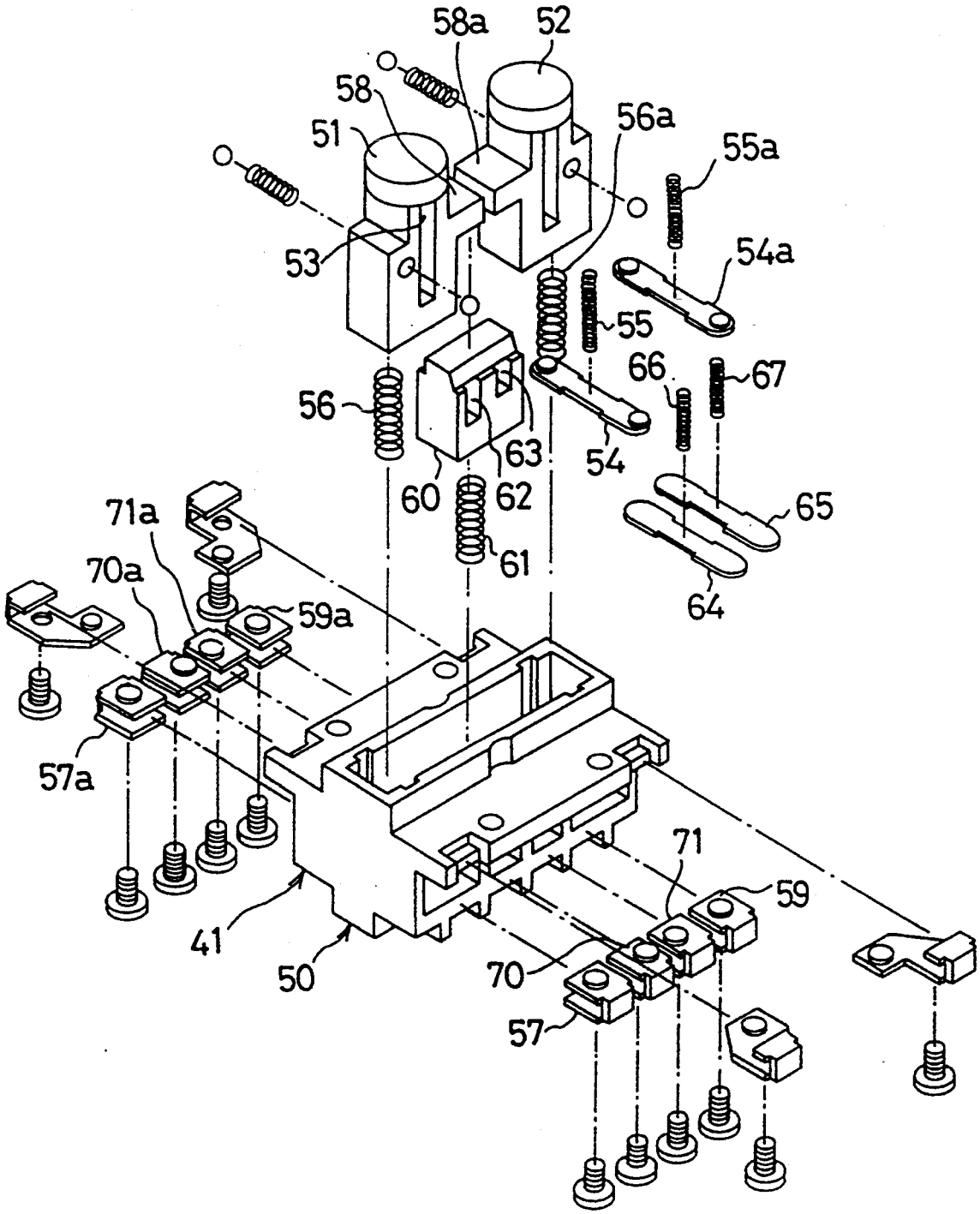
FIG. 15 is a perspective view of the push-button switch of the fifth example.

Next, FIG. 13 and FIG. 15 indicate the fifth example of the push-button switch device. The switch unit 41 of the push-button switch device 40 of this example indicates utilization of a transformed 3-stage push-button switch. The switch unit 41 is provided with 2 push-button switches PB7, PB8. While the respective first contacts 43, 44 of those push-button switches PB7, PB8 close individually, the second and the third contacts 45, 46 are designed to close if either of the push-button switches is pressed down. An example is given in FIG. 15.

This switch unit 41 is realized by inserting push buttons 51, 52 at a certain distance between them in a case 50. The two push buttons have a same structure. Therefore, one push button 51 will be explained hereafter while the other push button 52 will be given with a suffix "a" attached to a same symbol for a same part, but the explanation for it will be omitted.

This push button 51 is provided with a contactor 54 of rectangular shape to be inserted in a slit 53. The contactor 54 is braced down into the slit by a spring 55 and the push button 51 itself is also braced at the head in the direction protruding from the case 50 by a spring 56. 57, 57*a* indicate left and right contacts. 58 indicates a projection protruding from the push button 51 to the side of the other push button 52 while 60 indicates an intermediate switch provided between the two push buttons 51, 52. The intermediate switch 60 is braced to the side of the projections 58, 58*a* by a spring 61. Long and short slits 62, 63 are formed in this intermediate switch 60 and rectangular contactors 64, 65 are inserted in those slits and braced to the bottom face side of the slits by springs 66, 67. 70, 70*a* indicate left and right contacts for the contactor 64 inserted in the slit 62 while 71, 71*a* indicate left and right contacts for the contactor 65 inserted in the slit 63, 59, 59*a* are left and right contacts for the contactor 54*a* on the side of the other push button 52.

In such a structure, the contactor 54 connects the contacts 57, 57*a* with pressing down of the first stage of the push button 51. Moreover, the contactor 54 connects the contacts 59, 59*a* with pressing down of the first stage of the push button 52. Next, pressing down of the second stage of the push button 51 or 52 presses down the intermediate switch 60, and the contactor 64 in the slit 62 connects the contacts 70, 70*a*. With further pressing down of the push button 51 or 52, the contactor 65 in the short slit 63 connects the contacts 71, 71*a*. The contacts 57, 57*a* in this case correspond to said contact 44, contacts 59, 59*a* to contact 44, contacts 70, 70*a* to contact 45 and contacts 71, 71*a* to contact 46. This case 50 houses diodes to be described later, but illustration of such diodes is omitted.

The switch unit 41 is provided with 3 diodes D1, D2, D3 in addition to the respective push-button switches PB7, PB8 and the respective diodes are connected as shown in the drawing. The outputs to transmitting lines S8, S9 by this connection are as shown in FIG. 14. The output unit 42 may be realized with a structure as shown in FIG. 12.

Figures 16, 17:
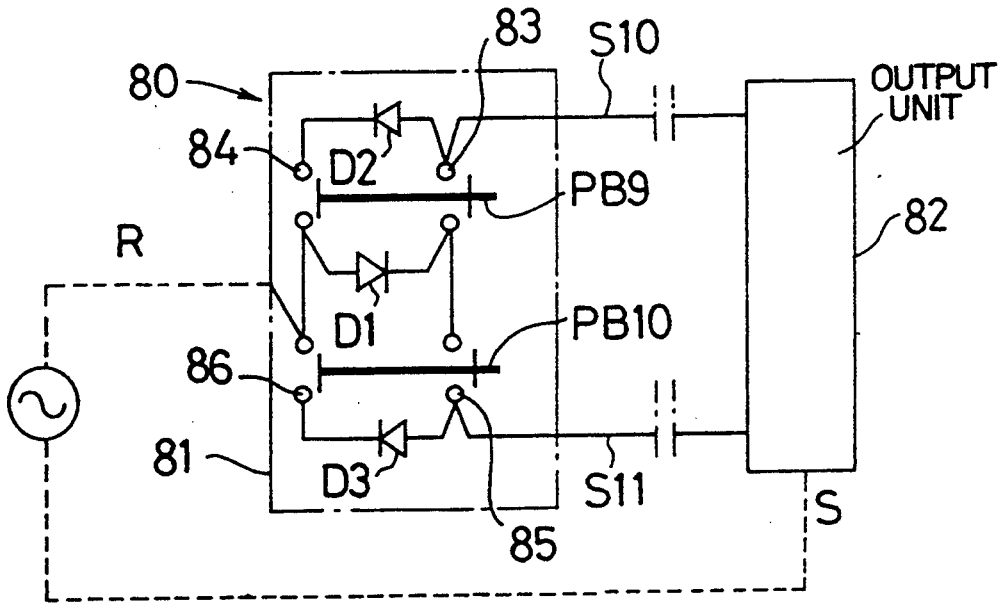
FIG. 16 is a general circuit diagram of the sixth example of the push-button switch device of the present invention.
FIG. 17 is an explanatory chart of a signal current of the sixth example.
Figure 18:
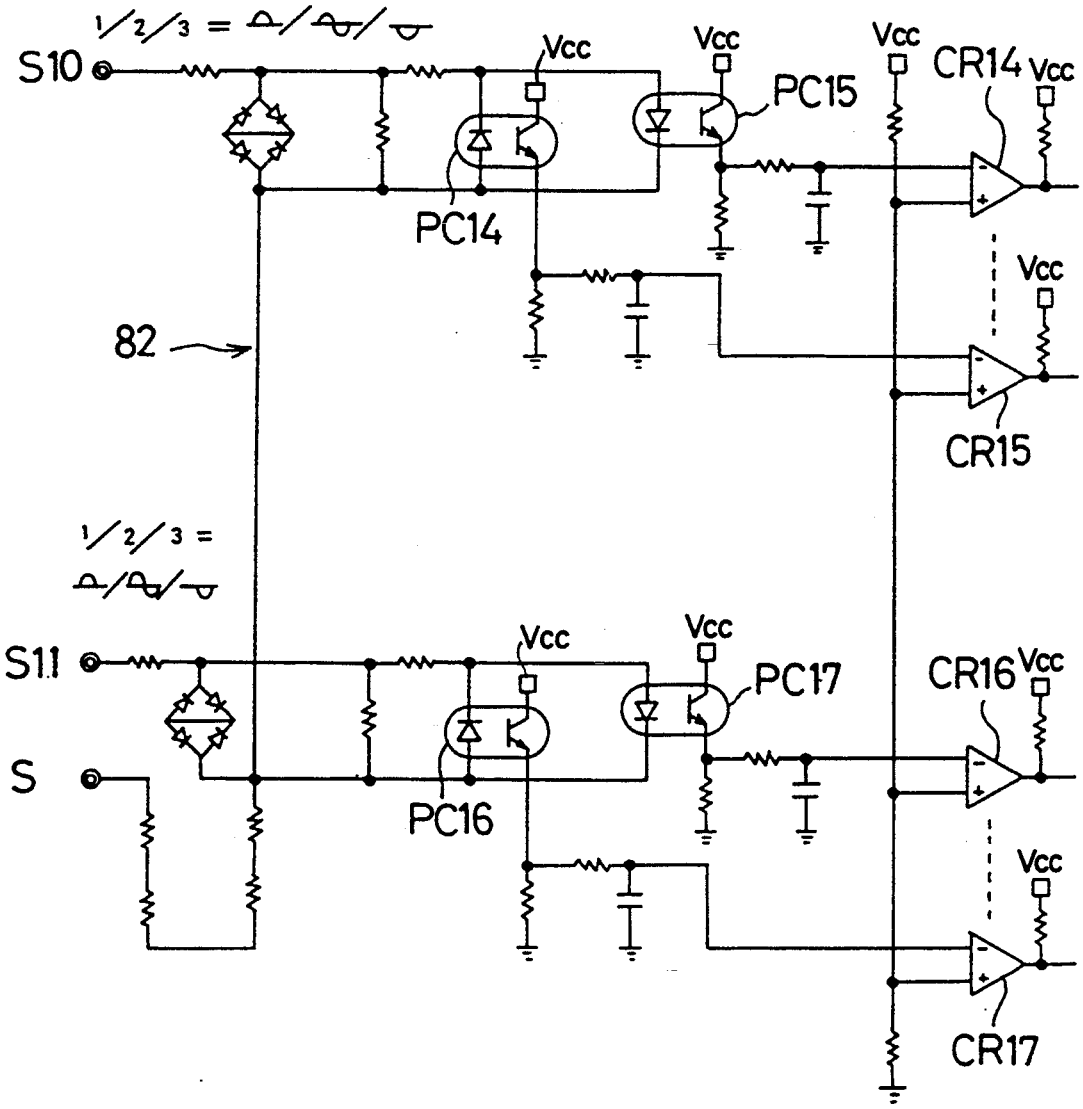
FIG. 18 is a circuit diagram of the output unit of the sixth example.
Figure 19:
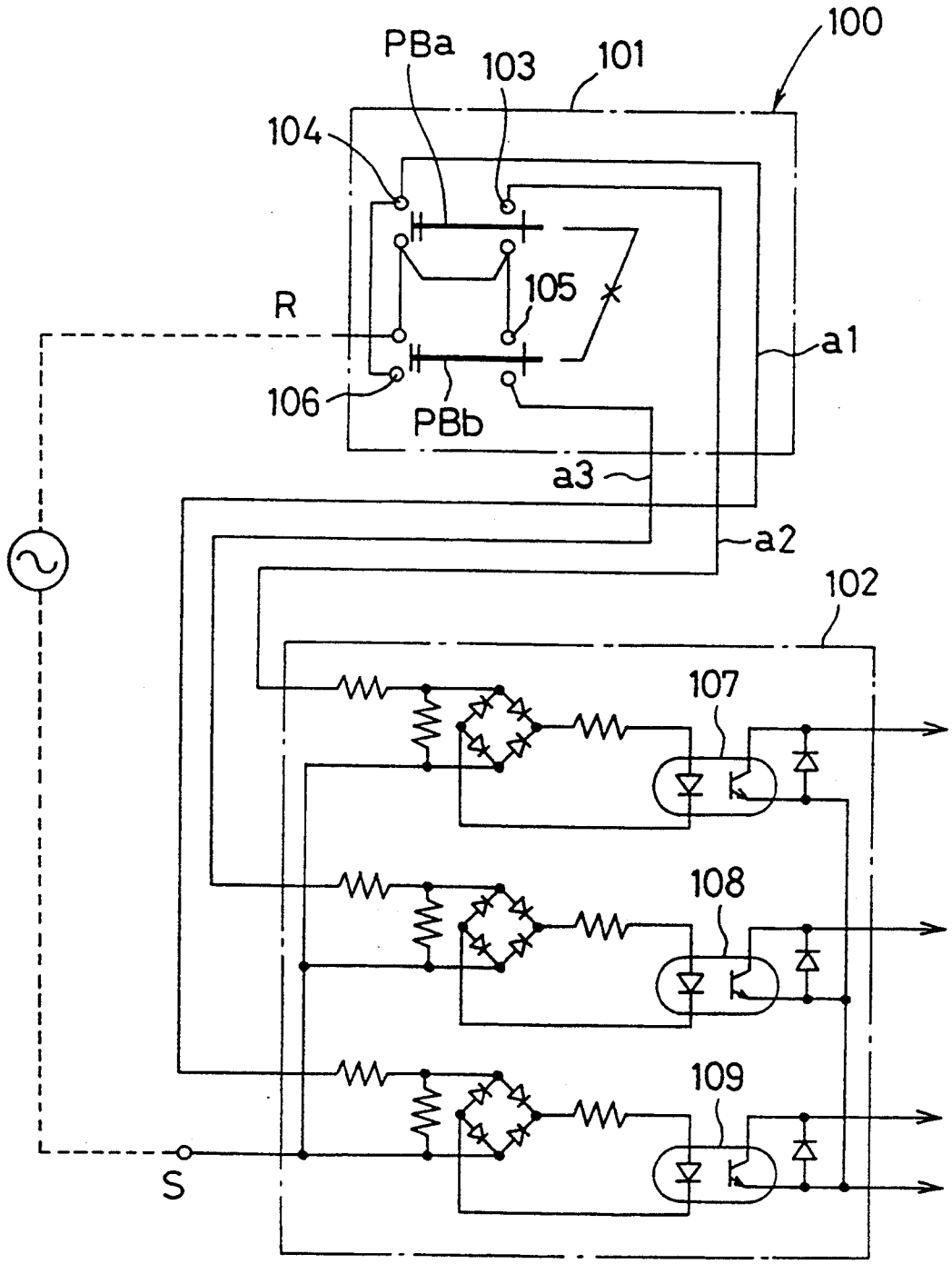
FIG. 19 PRIOR ART
FIG. 19 is a circuit diagram of switch signals for inverter control using a conventional 2-stage push-button switch device.

Next, FIG. 16 to FIG. 18 indicate the sixth example of the push-button switch device. The push-button switch device 80 of this example consists of a switch unit 81 and an output unit 82. The switch unit 81 is constituted by 3-stage push-button switches PB9, PB10, which make outputs by combination of 2 contacts, and 3 diodes D1, D2, D3. Namely, the push-button switches PB9, PB10 are 3-stage switches provided each with first contacts 83, 85 and second contacts 84, 86, and neither contact is turned on during a state (i.e., zero stage) in which the push-button switch PB9 is not pushed down. The first contact 83 is turned on with pressing down of the first stage of the push-button switch PB9 and the first and second contacts 83, 84 are turned on with pressing down of the second stage. With further pressing down of the third stage, the first contact is turned off and only the second contact 84 is turned on. The same is true with the other push-button switch PB10. The diode D1 is mounted in the direction opposite to that of the other diodes D2, D3.

With such a arrangement, the outputs obtained with the closing of respective contacts are those of pulsating signal current of positive half-wave rectification, alternating waveform signal current and pulsating signal current of negative half-wave rectification as shown in FIG. 17 which are obtained in order. The respective contacts 83, 84 of the push-button switch PB9 are connected to the output unit 82 through a common transmitting line S10 while respective contacts 85, 86 of the push-button switch PB11 are connected to the output unit 82 through a common transmitting line S11.

FIG. 18 indicates the output unit 82. In the interface circuit of this output unit 82, 2 discriminating means PC14, PC15 are provided on the transmitting line S10 and 2 discriminating means PC16, PC17 are provided on the transmitting line S11 respectively, to apply signals to comparators CR14–CR17 through an integrating circuit of resistors and capacitors, respectively. Namely, this example is realized in such a way that the 4 kinds of signals by the push-button switch PB9 are transmitted to the output unit through one transmitting line S11, the 4 kinds of signals by the push-button switch PB10 are transmitted to the output unit through one transmitting line S12 respectively and that the output unit 82 discriminates those signals and transmits output signals according to such signals.

What is claimed is:

1. A push-button switch device comprising:

a switch unit, having first and second outputs, which receives an AC signal and includes first and second push-button switches and at least three rectifying diodes coupled to said first and second push-button switches, wherein each of said first and second push-button switches is a 3-stage switch, and wherein said first and second push-button switches and said at least three rectifying diodes of said switch unit are configured such that said switch unit selectively generates any one of a null-signal, a positive half-wave rectified signal, a negative half-wave rectified signal and a full-wave alternating signal to each of the first and second outputs according to a switching state of each of said first and second push-button switches;

first and second transmission wires coupled to said first and second outputs of said switch unit, respectively; and, an output unit, having respective first and second inputs coupled to said first and second transmission wires, for discriminating the switching state of each of said first and second push-button switches according to the signals received from said switch unit via said first and second transmission wires, and for generating operating signals which are indicative of the discriminated switching state of the first and second push-button switches.

* * * * *